US011092160B2

(12) United States Patent
Peshcherenko et al.

(10) Patent No.: US 11,092,160 B2
(45) Date of Patent: Aug. 17, 2021

(54) SUBMERSIBLE SEALED MOTOR PUMP ASSEMBLY

(71) Applicant: Aktsionernoe Obshchestvo "Novomet-Perm", Perm (RU)

(72) Inventors: Marina Petrovna Peshcherenko, Perm (RU); Sergej Nikolaevich Peshcherenko, Perm (RU); Natalya Anatolevna Lykova, Perm (RU)

(73) Assignee: AKTSIONERNOE OBSHCHESTVO "NOVOMET-PERM", Perm (RU)

( * ) Notice: Subject to any disclaimer, the term of this patent is extended or adjusted under 35 U.S.C. 154(b) by 0 days.

(21) Appl. No.: 16/637,178

(22) PCT Filed: May 15, 2019

(86) PCT No.: PCT/RU2019/000337

§ 371 (c)(1),
(2) Date: Feb. 6, 2020

(87) PCT Pub. No.: WO2019/226072

PCT Pub. Date: Nov. 28, 2019

(65) Prior Publication Data

US 2020/0370558 A1 Nov. 26, 2020

(30) Foreign Application Priority Data

May 21, 2018 (RU) ..... 2018118744

(51) Int. Cl.

| | |
|---|---|
| ***F04D 13/08*** | (2006.01) |
| ***E21B 43/12*** | (2006.01) |
| ***F04D 13/02*** | (2006.01) |
| ***F04D 29/046*** | (2006.01) |
| ***F04D 29/58*** | (2006.01) |

(52) U.S. Cl.

CPC ..... *F04D 13/08* (2013.01); *E21B 43/128* (2013.01); *F04D 13/024* (2013.01); *F04D 29/046* (2013.01); *F04D 29/5806* (2013.01)

(58) Field of Classification Search

CPC ..... F04B 17/03; F04B 23/021; F04B 47/00; F04B 47/06; F04D 13/024; F04D 13/025;
(Continued)

(56) References Cited

U.S. PATENT DOCUMENTS 4,277,707 A * 7/1981 Silver ..... H02K 49/106 310/104
5,322,421 A * 6/1994 Hansen ..... F04C 15/0096 417/410.1

(Continued)

FOREIGN PATENT DOCUMENTS

CN 105422065 A 3/2016
DE 4009199 A1 * 9/1991 ..... F04D 29/061

(Continued)

OTHER PUBLICATIONS

Decision to Grant a patent dated Jan. 11, 2019, for Russian Patent Application No. 2018118744.

(Continued)

*Primary Examiner* — Charles G Freay
*Assistant Examiner* — Chirag Jariwala
(74) *Attorney, Agent, or Firm* — Meunier Carlin & Curfman LLC

(57) ABSTRACT

The invention relates to pump engineering and, in particular, to submersible pump assemblies driven by a sealed submersible electric motor for pumping well fluids. The submersible pump assembly comprises a pump, a motor, and a magnetic coupling comprising driving and driven half-couplings having permanent magnets and affixed to the motor rotor and pump rotor, respectively, a protective screen arranged between the rotors, and an intermediate bearing support. The assembly further comprises a magnetic coupling cooling device for cooling the magnetic coupling. When well fluid is a mixture of water and oil, a separator is (Continued)

preferably used as the magnetic coupling cooling device. When producing low-viscosity well fluid, the coupling is sufficiently cooled without additional separation of the produced fluid, and for this reason a set of pumping stages may be used as the cooling device. The invention increase operation time of the pump assembly at high shaft speeds and high shaft torques.

10 Claims, 5 Drawing Sheets

(58) Field of Classification Search
CPC ..... F04D 13/027; F04D 13/06; F04D 13/08; F04D 13/086; F04D 29/046; F04D 29/5806; H02K 7/003; E21B 43/128
See application file for complete search history.

(56) References Cited

U.S. PATENT DOCUMENTS

| | | | | |
|---|---|---|---|---|
| 5,501,582 | A | 3/1996 | Gautier et al. | |
| 5,857,842 | A | 1/1999 | Sheehan | |
| 6,863,124 | B2 | 3/2005 | Araux et al. | |
| 2003/0132003 | A1 | 7/2003 | Arauz et al. | |
| 2016/0333677 | A1 * | 11/2016 | Westberg | F04D 13/025 |

FOREIGN PATENT DOCUMENTS

| | | | | |
|---|---|---|---|---|
| RU | 2616 | U1 | 3/2006 | |
| RU | 52124 | U1 | 3/2006 | |
| RU | 170819 | U1 * | 5/2017 | F04B 39/06 |
| RU | 170819 | U1 | 5/2017 | |
| SU | 492979 | A1 | 11/1975 | |
| SU | 909342 | | 2/1982 | |

OTHER PUBLICATIONS

International Search Report dated Sep. 19, 2019 for International Application No. PCT/RU2019/000337.
Written Opinion dated Sep. 19, 2019 for International Application No. PCT/RU2019/000337.
"Electrical submersible pumps manual: Design, operations and maintenance", Gulf Professional Publishing, 2009, pp. 147-148.

* cited by examiner

SUBMERSIBLE PUMP ASSEMBLY WITH A SEALED MOTOR

SUBMERSIBLE PUMP ASSEMBLY
WITH A SEALED MOTOR

SUBMERSIBLE PUMP ASSEMBLY
WITH A SEALED MOTOR

SUBMERSIBLE PUMP ASSEMBLY
WITH A SEALED MOTOR

SUBMERSIBLE PUMP ASSEMBLY
WITH A SEALED MOTOR

SUBMERSIBLE SEALED MOTOR PUMP ASSEMBLY

The invention relates to pump engineering and, in particular, to submersible pump assemblies driven by a sealed submersible electric motor for pumping well fluid.

Known from the state of the art is a submersible sealed motor pump assembly comprising a sealed electric motor, a magnetic coupling, and a well pump, wherein the inner cavity of the electric motor is sealed and protected from entering the reservoir fluid, torque from the motor shaft is transferred to the pump shaft due to the engagement between permanent magnets attached to the driving and driven half-couplings of the magnetic coupling, which are rigidly coupled to the motor shaft and pump shaft, and separated by a protective screen (Russian patent No. 52124 for a utility model, published on May 10, 2006).

The known magnetic coupling lacks radial support making the coupling construction less robust and imposing limitations on the length of the coupling and torque transmission, so that the long term use of the assembly at higher shaft speeds becomes nearly impossible.

Further, known from U.S. Pat. No. 6,863,124 (IPC E21B 43/00, USPC 16664, published on Jul. 17, 2003) is a submersible pump assembly comprising a well pump and a submersible electric motor coupled to each other through a magnetic coupling, the coupling comprises a driving and driven half-couplings having permanent magnets and affixed to the motor rotor and the pump rotor, a protective screen made of a non-magnetic non-conductive material and located between the rotors, and an intermediate bearing support having three intermediate bearings concentric with one another at the same axial position. The coupling faces of the bearings are located in a narrow gap between the screen and the magnets. The gap between the driving half-coupling and the protective screen that isolates the motor inner cavity from the environment, is filled with motor oil. The gap between the protective screen and the driven half-coupling is filled with well fluid when the assembly is in operation.

During operation of the assembly, substantial heating occurs in the magnetic coupling due to viscous friction in a fluid layer adjacent to the rotatable wall, wherein the higher the fluid viscosity and shaft speed, the greater the heating. In operation, the temperature tends to rise inside the assembly and the permanent magnets lose their magnetic properties upon reaching the Curie temperature. Further, the bearings are arranged so that passing of pumping cooling fluid that may potentially be pumped through the gap is prevented or may be allowed upon providing a gap of greater thickness. In the first case, the bearing overheat is inevitable, which leads to a limited service life and robustness of the entire assembly, and in the second case, there is a limitation on the transferred torque, which leads to reduced productivity.

The object of the present invention is to create a submersible sealed motor pump assembly of robust construction for long term operation at high shaft speeds and high shaft torques.

The object is achieved by the submersible pump assembly with a sealed motor (or submersible sealed motor pump assembly) comprising a submersible pump, a motor, and a magnetic coupling comprising driving and driven half-couplings having permanent magnets mounted in the half-couplings, a protective screen arranged between the half-couplings, and an intermediate bearing support. The assembly further comprises a magnetic coupling cooling device.

The magnetic coupling cooling device prevents the magnets overheat caused by substantial heat production during the rotation of the half-couplings caused by viscous friction in fluids filling the gaps on different sides of the protective screen. The device pumps the fluid through the coupling and removes excessive heat therefrom.

The magnetic coupling cooling device may comprise an oil/water separator withdrawing and separating well fluid and further pumping the separated water through the gap between the protective screen and the driven half-coupling in order to cool magnets. This is particularly applicable when the well fluid is a mixture of water and oil.

When producing a low-viscosity well fluid, the coupling is sufficiently cooled without additional separation of the produced fluid, and, thus, the cooling device may comprise a set of pumping stages adapted to withdraw the necessary amount of the well fluid, then pump it through the gap between the protective screen and the driven half-coupling and release the well fluid back into the well.

When producing a well fluid of high-viscosity and low water-cut, the well fluid cooling device may additionally be provided with a surface fluid supply unit for pumping through the gap between the protective screen and the driven half-coupling.

To pump the well fluid or water separated therefrom, the driven half-coupling has a central opening fluidly connected to said gap and returning the heated well fluid or heated separated water into the well. Furthermore, the driving and driven half-couplings have recesses, wherein the recesses form an extension of flow channels for the circulation of cooling fluid, which is well fluid or separated water, in the coupling, which flow channels have radial bearings mounted therein with channels for the passage of cooling fluid.

The present invention will become apparent from the following detailed description when taken in conjunction with the accompanying drawings. The drawings include the following Figures.

Figure 5:
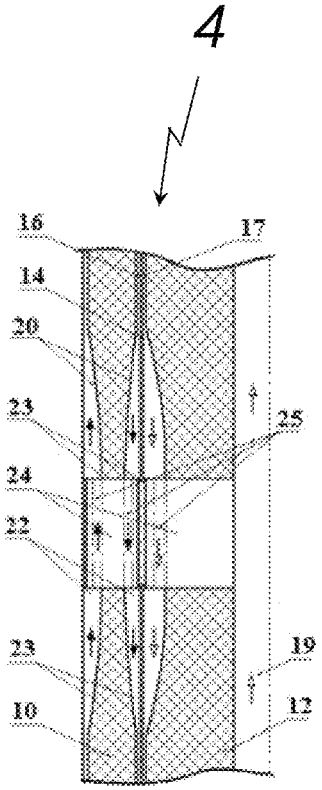
Figure 6:
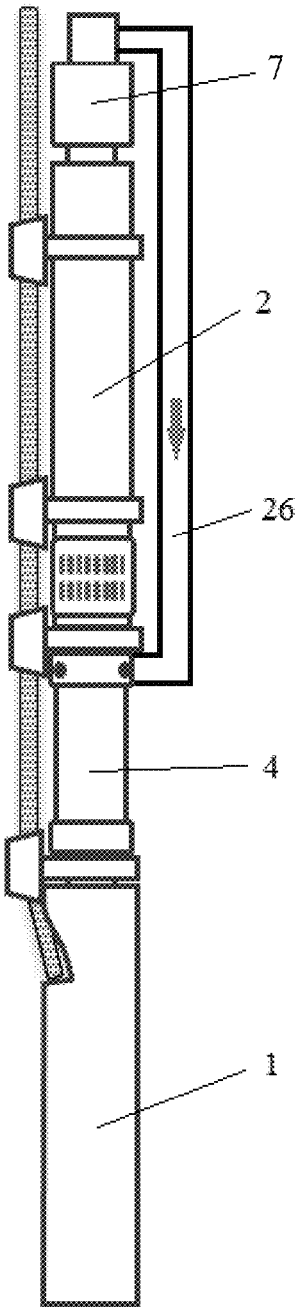

FIG. 5 shows a sectional view of the magnetic coupling of the submersible pump assembly having recesses formed in the half-couplings of the magnetic coupling for mounting radial bearings according to one embodiment; and FIG. 6 shows a diagram of the submersible pump assembly having a magnetic coupling cooling device comprising a rotary type separator mounted above a pump according to according to one embodiment.

Figure 1:
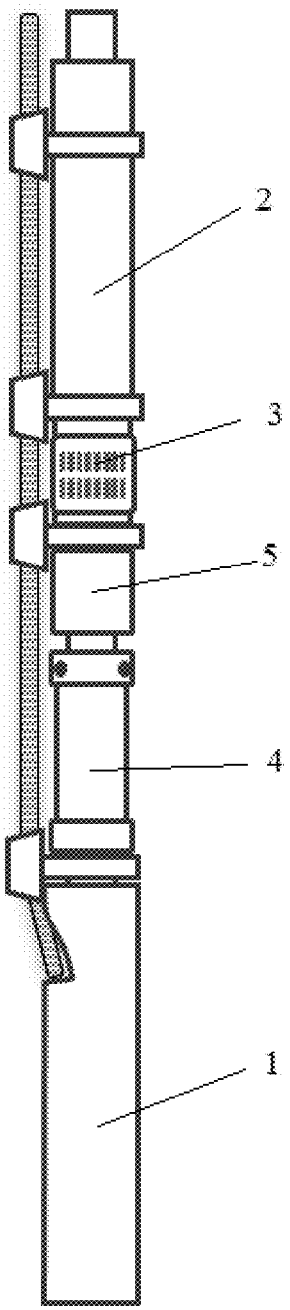
FIG. 1 shows a diagram of the submersible pump assembly having a magnetic coupling cooling device arranged between a magnetic coupling and a pump according to one embodiment.
Figure 2:
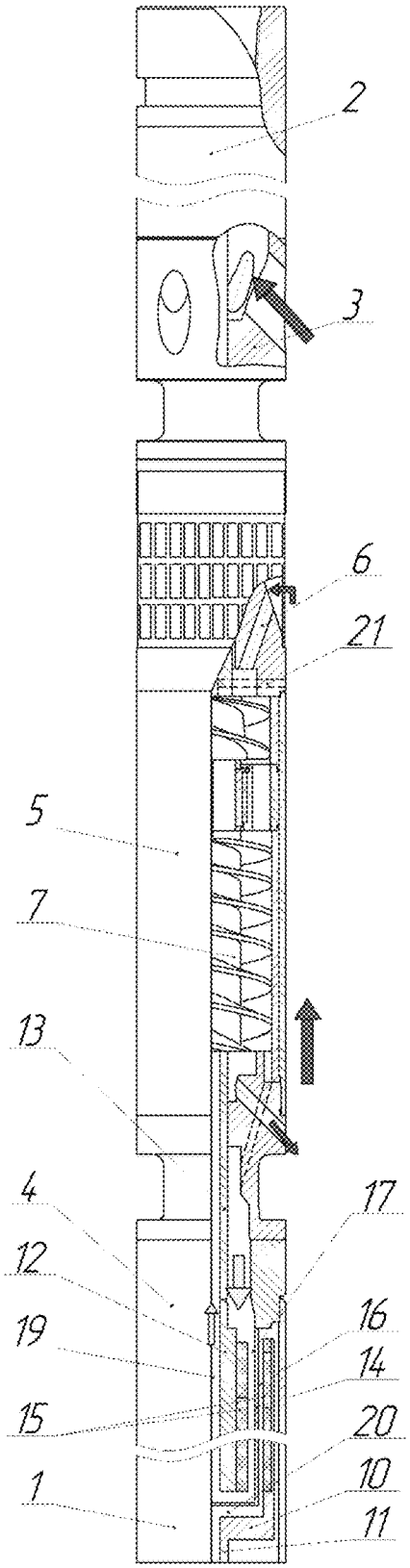
FIG. 2 shows a diagram of the submersible pump assembly having a magnetic coupling cooling device comprising a rotary type separator according to one embodiment.
Figure 3:
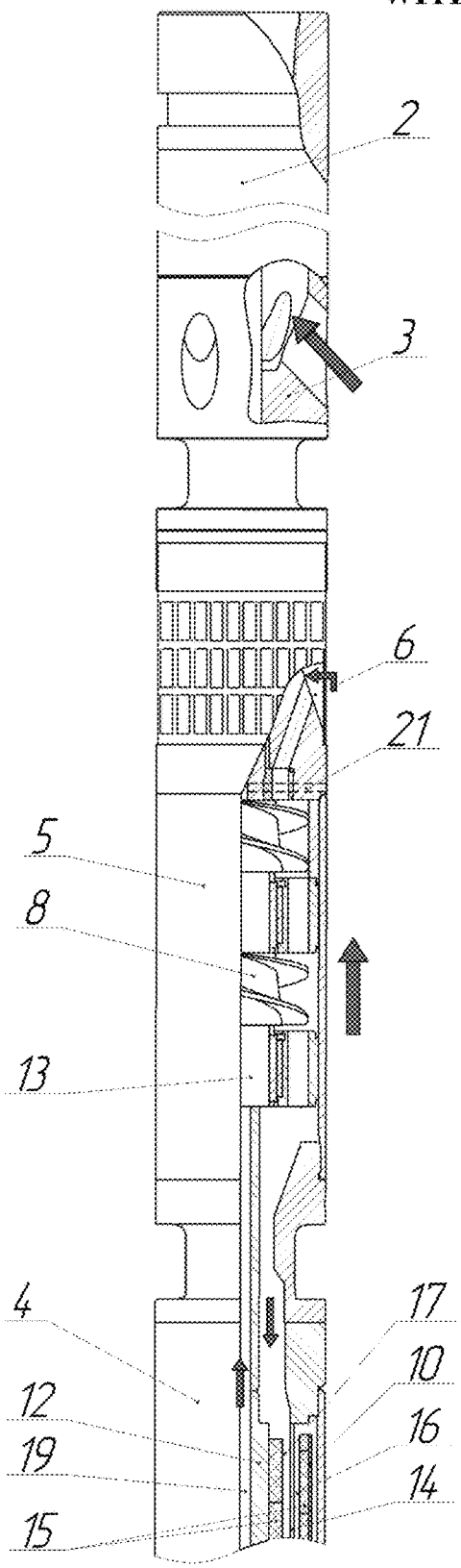
FIG. 3 shows a diagram of the submersible pump assembly having a magnetic coupling cooling device comprising a set of pumping stages according to one embodiment.
Figure 4:
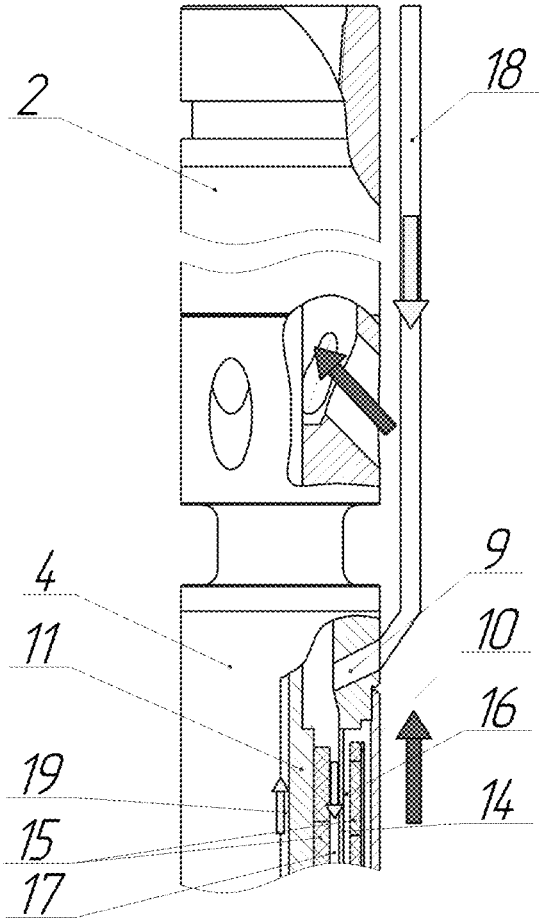
FIG. 4 shows a diagram of the submersible pump assembly having a magnetic coupling cooling device comprising a surface fluid supply unit according to one embodiment.

The submersible pump assembly comprises a submersible electric motor 1 and a well pump 2 with an inlet module 3, coupled to each other through a magnetic coupling 4. As can be seen from FIG. 1, the assembly further comprises the magnetic coupling cooling device 5, arranged between the magnetic coupling 4 and the well pump 2, on a common shaft with the latter. The cooling device 5, in its upper portion, comprises a well fluid withdrawal unit 6. Depending on the fluid produced, in particular on its properties such as water-cut and viscosity, the cooling device 5 may comprise an oil/water separator 7, for example separator of a rotary or rotary vortex type (FIG. 2), or a set of pumping stages 8 (FIG. 3). Further, the cooling device 5 may comprise a surface fluid supply unit 9 (FIG. 4). According to an embodiment of the present invention, the oil/water separator 7 may be mounted above the well pump 2 (FIG. 6).

The coupling 4 comprises a driving half-coupling 10 coupled to a shaft 11 of the electric motor 1, and a driven half-coupling 12 coupled to a shaft 13 of the well pump 2 through a cooling device 5 shaft, a protective screen 14, and permanent magnets 15 mounted in the half-couplings 10 and 12. There is an annular gap 16 between the driving half-coupling 10 and the protective screen 14, which is filled with motor oil, and an annular gap 17 formed between the protective screen 14 and the driven half-coupling 12 is arranged for the passage of the cooling fluid that has been withdrawn from the well during operation or that is being pumped from the surface via a pipe 18 through the supply unit 9 (FIG. 4). The driven half-coupling 12 has a central opening 19 fluidly connected to the gap 17 through the lower end channel 20 (FIG. 2), and to the annular space through the upper channels 21 (FIG. 2, 3).

To improve robustness of the magnetic coupling 4, recesses 22 with smooth depressions 23 are formed in the driving half-coupling 10 on both cylindrical sides and on the outer cylindrical side of the driven half-coupling 12 for mounting radial bearings 24 having flow channels 25 that allow free passage of the cooling fluid (FIG. 5).

In assemblies for pumping low-viscosity fluid, the cooling device comprises a set of pumping stages 8 (FIG. 3) adapted to withdraw an amount of well fluid, pump it further through the gap 17 between the protective screen 14 and the driven half-coupling 12, and remove the heated well fluid back into the well through the central opening 19 inside the shaft 12 and further through the upper channels 21.

According to an embodiment of the present invention, the oil/water separator 7 may be mounted above the well pump 2, and the purified fluid may be supplied from the separator 7 to the inlet of the magnetic coupling 4 through a connecting pipe 26 (FIG. 6).

The submersible pump assembly operates as follows.

After the assembly is lowered into the well, the well fluid enters the magnetic coupling cooling device 5 through the withdrawal unit 6, passes through a flow portion of the separator 7 or through flow channels of the set of pumping stages 8, further flows into the magnetic coupling 4 where it fills the annular gap 17 formed between the protective screen 14 and the driven half-coupling 12.

Once powered, the electric motor 1 rotates the driving half-coupling 10 coupled to the electric motor shaft 11. Permanent magnets 15 fixed on the driving half-coupling 10 create rotating magnetic field that interacts with permanent magnets 15 disposed in the driven half-coupling 12. By this interaction, the driven half-coupling 12 coupled to the shaft 13 of the separator 7 (or the set of pumping stages 8) and of the successively arranged well pump 2, is involved in the rotating motion. Thus, torque is transmitted from the driving half-coupling 10 to the driven half-coupling 12 without mechanical contact between them, so that the pump 2 and the cooling device 5 of the magnetic coupling 4 mounted therewith on the common shaft 13 are activated to pump the well fluid.

During operation of the electric motor 1, one part of a common flow of the well fluid enters the cooling device 5 of the magnetic coupling 4 through the withdrawal unit 6, and the other, larger, part of the common flow enters the well pump 2 through the inlet module 3 of the pump 2. In the well pump 2, the fluid acquires energy raising the fluid from the well onto the surface. A part of the fluid that has entered the cooling device 5 is pumped through the magnetic coupling 4 and is returned back into the well carrying excessive heat therewith.

According to one of the embodiments, the well fluid, which is a mixture of water and oil (shaded arrows), enters the separator 7 (FIG. 2) where it is separated to phases of different density in the centrifugal force field—a denser one (water) moves to the periphery of the separator, and a less dense one (oil) gathers at the axis of rotation. Separated water is directed from the periphery (contoured arrows) to the annual gap 17 of the magnetic coupling 4 and then enters the central opening 19 of the driven half-coupling 12 through the lower end channel 20. While moving along the gap 17, separated water is heated in result of viscous friction between a wall of the driven half-coupling 12, which rotates at a high speed, and a stationary wall of the protective screen 14, and after passing through the flow channels 25 in radial bearings 24, it exits to the annulus through the end channel 21. Thanks to the channels 25 in the bearings 24 mounted in the recesses 22 with smooth depressions 23 (FIG. 5), the fluid flow is not resisted while flowing along the gap 17 at the location where the radial bearings 24 are installed. At the same time, radial bearings 24, which function as a support for the driving 10 and driven 12 half-couplings, minimize vibration of the entire system, which also makes the performance of the coupling more reliable when the shaft speed is increased. Thus, the water flow heated in the gap 17 flows outside the magnetic coupling 4 and is replaced by the unheated flow. With that, the temperature of the magnets 15 constant in time and system dynamic stabilization are set up so as to ensure reliable operation of the entire system.

Low-viscosity fluid (shaded arrows) does not require separation and is pumped into the annular gap 17 of the driven half-coupling 12 of the magnetic coupling 4 with the help of the set of pumping stages 8 (FIG. 3). While moving along the gap 17, in result of viscous friction between a wall of the driven half-coupling 12, which rotates at a high speed, and a stationary wall of the protective screen 14, the fluid is heated and exits to the annulus through the end channel 21 after passing through the flow channels 25 in radial bearings 24.

When using the assembly for producing well fluid of high-viscosity and low water-cut (FIG. 4), the annular gap 17 between the driven half-coupling 12 and the protective screen 14 is filled with low-viscosity fluid supplied from the surface via the pipe 18 through the supply unit 9. The embodiment with fluid injecting from the surface allows supplying clear fluid into the magnetic coupling 4, thus preventing the channels 17, 20, 21 from clogging.

There is also an embodiment (FIG. 6) where the cooling device 5 is the separator 7 mounted above the main pump 2, wherein separated fluid of low-viscosity and a high water content is supplied into the magnetic coupling 4 through the connecting pipe 26 and is then pumped into the annular gap 17 of the driven half-coupling 12 of the magnetic coupling 4. While moving along the gap 17, in result of viscous friction between the wall of the driven half-coupling 12, which rotates at a high speed, and the stationary wall of the protective screen 14, the water is heated, and after passing through the central channel 19 inside the shaft 13, flow channels 25 of radial bearings 24, it exits to the annulus through the end channel 21.

It should be noted that upon studying the features of the present invention and its exemplary implementations, other constructive changes and modifications will become apparent to a person skilled in the art. For example, from the pump end, the fluid may enter in the central opening in the driven half-coupling and exit through the annular channel between the protective screen and the driven half-coupling. Also, relative arrangement of the driving and driven half-couplings of the magnetic coupling may be changed—the driving half-coupling may be formed internally, and the driven one—externally. All such modifications are intended to fall within the scope of the present disclosure.

In conclusion, using the claimed construction for various well fluids allows transferring torque reliably at high temperatures due to moving the heated fluid or water outside the coupling.

The invention claimed is:

1. A submersible sealed motor pump assembly for pumping a well fluid, the assembly comprising:

a pump, a motor, and a magnetic coupling adapted to couple the pump and the motor to each other, wherein the magnetic coupling comprises driving and driven half-couplings having permanent magnets mounted in the half-couplings, the submersible sealed motor pump assembly further comprises a protective screen arranged between the half-couplings, and an intermediate bearing support, wherein an annular gap is defined between the protective screen and the driven half-coupling, and the submersible sealed motor pump assembly further comprises a magnetic coupling cooling device, wherein the magnetic coupling cooling device comprises a set of pumping stages, the set of pumping stages are adapted to withdraw the well fluid from a well and further adapted to pump the well fluid through the annular gap to cool the permanent magnets of the half-couplings, and to remove the well fluid outside the magnetic coupling back to the well.

2. The assembly according to claim 1, wherein the magnetic coupling cooling device is arranged between the magnetic coupling and the pump.

3. The assembly according to claim 1, wherein the driving and driven half-couplings have recesses, the recesses form an extension of flow channels for circulation of the well fluid in the magnetic coupling, and the driving and driven half-couplings are supported by radial bearings mounted in the recesses, wherein the radial bearings have channels for the passage of the well fluid, wherein the intermediate bearing support comprises the radial bearings.

4. A submersible sealed motor pump assembly for pumping a well fluid, the assembly comprising:

a pump, a motor, and a magnetic coupling adapted to couple the pump and the motor to each other, wherein the magnetic coupling comprises driving and driven half-couplings having permanent magnets mounted in the half-couplings, the submersible sealed motor pump assembly further comprises a protective screen arranged between the half-couplings and an intermediate bearing support, wherein an annular gap is defined between the protective screen and the driven half-coupling, and the submersible sealed motor pump assembly further comprises a magnetic coupling cooling device, wherein the magnetic coupling cooling device comprises a rotary type separator, the rotary type separator is adapted to withdraw the well fluid from a well and separate water from the withdrawn well fluid, as well as to pump the water through the annular gap to cool the permanent magnets of the half-couplings, and remove the water outside the magnetic coupling back to the well.

5. The assembly according to claim 4, wherein the driving and driven half-couplings have recesses, the recesses form an extension of flow channels for circulation of the water in the magnetic coupling, and the driving and driven half-couplings are supported by radial bearings mounted in the recesses, wherein the radial bearings have channels for the passage of the water, wherein the intermediate bearing support comprises the radial bearings.

6. The assembly according to claim 4, wherein the magnetic coupling cooling device is arranged between the magnetic coupling and the pump.

7. The assembly according to claim 4, wherein the separator is mounted above the pump and communicates with the annular gap between the protective screen and the driven half-coupling by means of a connecting pipe for supplying the water.

8. A submersible sealed motor pump assembly for pumping a well fluid, comprising:

a pump, a motor, and a magnetic coupling adapted to couple the pump and the motor to each other, wherein the magnetic coupling comprises driving and driven half-couplings having permanent magnets mounted in the half-couplings, the submersible sealed motor pump assembly further comprises a protective screen arranged between the half-couplings and an intermediate bearing support, wherein an annular gap is defined between the protective screen and the driven half-coupling, and the submersible sealed motor pump assembly further comprises a magnetic coupling cooling device, wherein the magnetic coupling cooling device comprises a surface fluid supply unit fluidly connected to the annular gap, the surface fluid supply unit is adapted to withdraw the well fluid from a well and further adapted to pump the well fluid through the annular gap to cool the permanent magnets of the half-couplings, and to remove the well fluid outside the magnetic coupling back to the well.

9. The assembly according to claim 8, wherein the driving and driven half-couplings have recesses, the recesses form an extension of flow channels for circulation of the well fluid in the magnetic coupling, and the driving and driven half-couplings are supported by radial bearings mounted in the recesses, wherein the radial bearings have channels for the passage of the well fluid, wherein the intermediate bearing support comprises the radial bearings.

10. The assembly according to claim 8, wherein the magnetic coupling cooling device is arranged between the magnetic coupling and the pump.

* * * * *